US006840780B1

(12) United States Patent
Antaya et al.

(10) Patent No.: US 6,840,780 B1
(45) Date of Patent: Jan. 11, 2005

(54) NON-SOLDER ADHESIVE TERMINAL

(75) Inventors: Stephen Antaya, West Kingston, RI (US); John P. Hendrick, West Kingston, RI (US); Manuel Machado, Hope, RI (US)

(73) Assignee: Antaya Technologies Corporation, Cranston, RI (US)

( * ) Notice: Subject to any disclaimer, the term of this patent is extended or adjusted under 35 U.S.C. 154(b) by 0 days.

(21) Appl. No.: 10/207,657

(22) Filed: Jul. 26, 2002

(51) Int. Cl.[7] ..... H01R 12/00

(52) U.S. Cl. ..... 439/78; 439/83; 343/713; 343/895

(58) Field of Search ..... 439/78, 83, 34, 439/916, 917; 343/713, 895, 906; 361/774, 779, 761, 754; 29/832, 845; 337/241, 206, 265, 243; 219/543, 465, 549; 340/550, 426

(56) References Cited

U.S. PATENT DOCUMENTS

| | | | | |
|---|---|---|---|---|
| 3,464,051 | A | 8/1969 | Webb | |
| 3,579,243 | A | 5/1971 | Dickason et al. | 343/713 |
| 3,757,087 | A | 9/1973 | Bernard | 219/549 |
| 3,783,242 | A | 1/1974 | Barnard | 219/546 |
| 3,794,953 | A | 2/1974 | Malin | |
| 4,023,008 | A | 5/1977 | Durussel | 219/522 |
| 4,450,346 | A | 5/1984 | Boaz | 219/522 |
| 4,992,801 | A | 2/1991 | Saito et al. | 343/713 |
| 5,098,320 | A | 3/1992 | Colleran et al. | 439/876 |
| 5,260,549 | A | 11/1993 | Garritano | 219/541 |
| 5,268,700 | A | 12/1993 | Hirotsu et al. | 343/713 |
| 5,308,247 | A | 5/1994 | Dyrdek | 439/34 |
| 5,479,179 | A | 12/1995 | Hirotsu et al. | 343/713 |
| 5,543,601 | A | 8/1996 | Bartrug et al. | 219/203 |
| 5,596,335 | A | 1/1997 | Dishart et al. | 343/713 |
| 5,650,080 | A | 7/1997 | Koneke | 219/203 |
| 5,705,983 | A | 1/1998 | Tweadey, II et al. | 340/550 |
| 5,748,155 | A | 5/1998 | Kadunce et al. | 343/713 |
| 6,024,585 | A | 2/2000 | Mickievicz et al. | |
| 6,043,782 | A | 3/2000 | Dishart et al. | 343/713 |
| 6,103,998 | A | 8/2000 | Kuno et al. | 219/203 |
| 6,320,159 | B1 | 11/2001 | Topp | 219/203 |

FOREIGN PATENT DOCUMENTS

| | | |
|---|---|---|
| EP | 1 156 550 A1 | 11/2001 |
| GB | 2 186 427 A | 8/1987 |

*Primary Examiner*—Alex Gilman
(74) *Attorney, Agent, or Firm*—Hamilton, Brook, Smith & Reynolds, P.C.

(57) ABSTRACT

An electrical terminal assembly includes an electrical terminal having an electrical connector for engaging a mating connector, and a base pad extending from the electrical connector. The base pad has a bottom electrical contact surface. A securement arrangement having an instant adhesive surface is adjacent to the bottom electrical contact surface of the base pad for instantly securing the base pad to a substrate.

18 Claims, 6 Drawing Sheets

NON-SOLDER ADHESIVE TERMINAL

BACKGROUND

Electrical terminals are typically soldered to a conductive surface to provide electrical connections to various devices. In automotive applications, electrical terminals can be soldered to a conductive terminal pad located on, for example, automotive glass such as a windshield or rear window, to provide electrical connection to devices on or embedded within the glass. Typical devices on or in windshields or rear windows, include window defrosters or antennas. A drawback of soldering electrical terminals to automotive glass is that the heat applied to the glass during soldering of the electrical terminals thereon, can in some cases, weaken or damage the glass. An alternative to the soldering process is to employ a conductive adhesive which secures the electrical terminal to the conductive terminal pad without the use of heat. However, currently available conductive adhesives take several hours to curve or harden, so that conductive adhesives are not usually suitable for high speed automated mass production.

SUMMARY

The present invention provides an electrical terminal assembly which can be instantly secured to a surface or substrate in electrical contact therewith without soldering. The electrical terminal assembly includes an electrical terminal having an electrical connector for engaging a mating connector, and a base pad extending from the electrical connector. The base pad has a bottom electrical contact surface. A securement arrangement having an instant adhesive surface is adjacent to the bottom electrical contact surface of the base pad for instantly securing the base pad to a substrate.

In preferred embodiments, the electrical terminal further includes a layer of conductive adhesive on the bottom electrical surface of the base pad for conductively adhering the bottom electrical surface to the substrate. The securement arrangement in one embodiment includes a retaining cover having at least one resilient member formed within the retaining cover with the at least one resilient member for resiliently pressing against the base pad of the electrical terminal. This presses the base pad against the substrate. The instant adhesive surface is on a bottom surface of the retaining cover for securing the retaining cover to the surface. The retaining cover includes an upper wall extending over the base pad of the electrical terminal and a side wall extending around the base pad for capturing the electrical terminal. The upper wall of the retaining cover includes an opening through which the electrical connector of the electrical terminal is extended. The electrical connector of the electrical terminal can be a blade connector.

The present invention electrical terminal assembly allows electrical terminals to be quickly secured in electrical connection with a conductive terminal pad without soldering, and therefore, without applying heat. In situations where the electrical terminal assembly is secured to automotive glass, elimination of the soldering process and the associated application of heat avoids the chance of weakening or damaging the glass. In addition, the elimination of the use of solder allows the electrical connection to be made in a lead free manner in view that many solder compositions include a percentage of lead.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF EMBODIMENTS OF THE INVENTION

Figure 1:
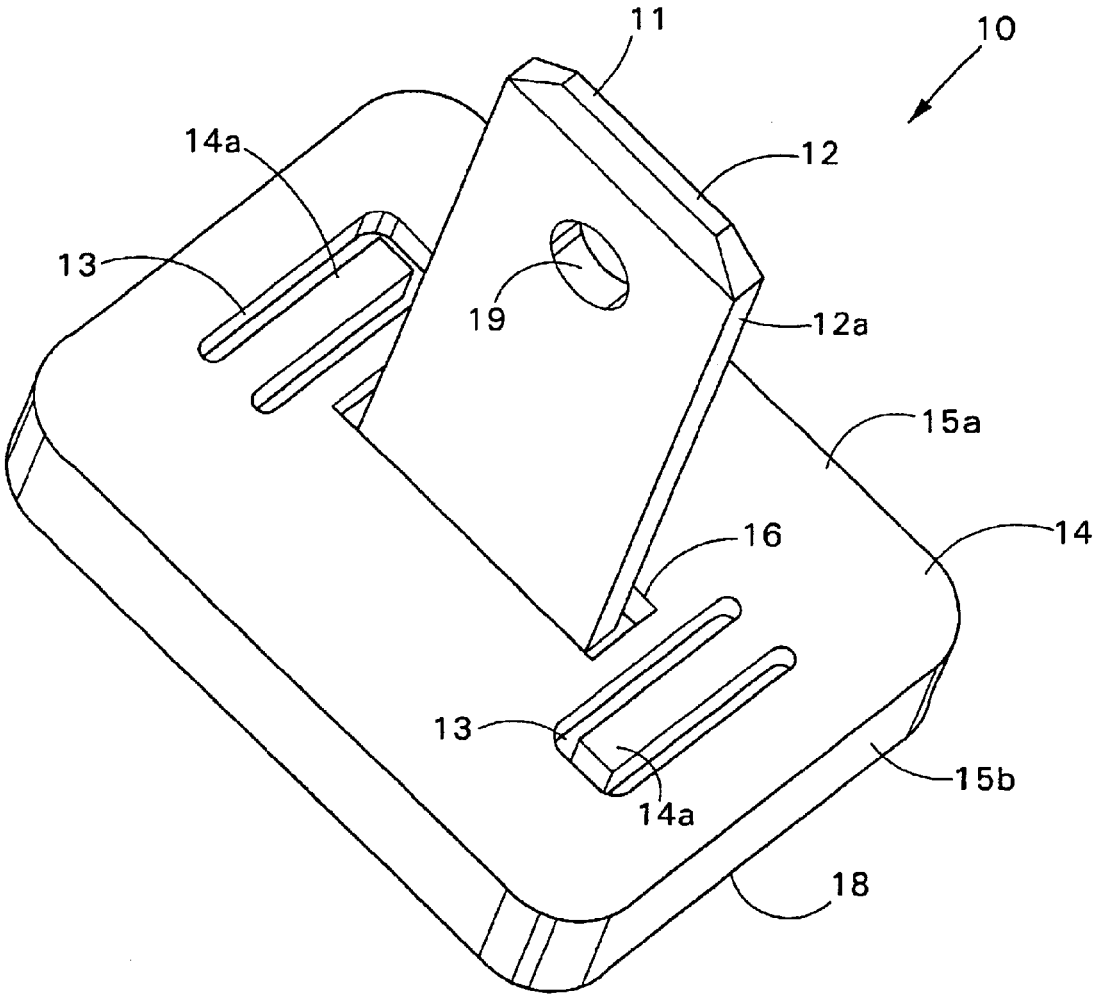
FIG. 1 is a top perspective view of an embodiment of the present invention electrical terminal assembly.
Figure 2:
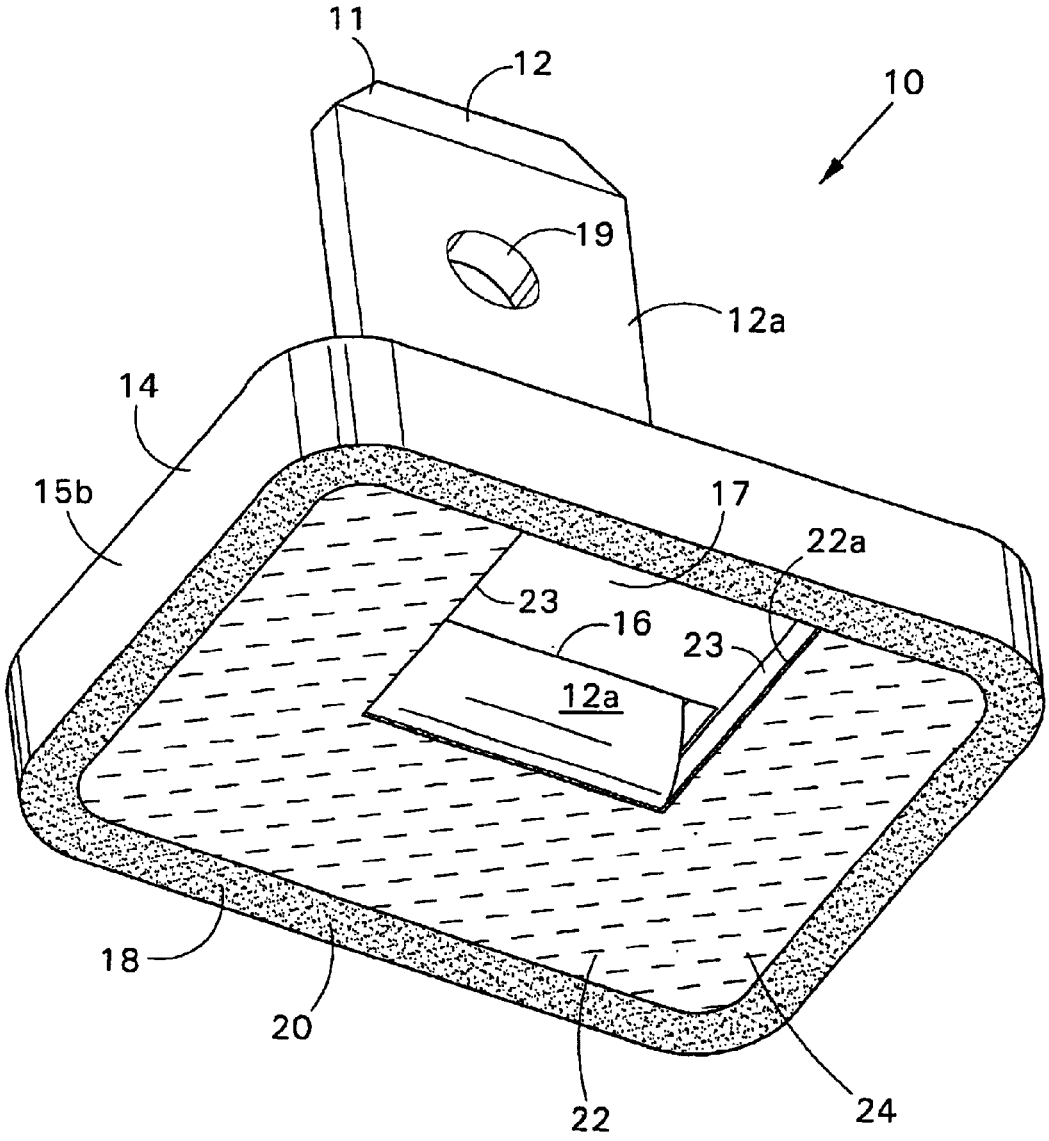
FIG. 2 is a bottom perspective view of the electrical terminal assembly depicted in FIG. 1.

Referring to FIGS. 1 and 2, electrical terminal assembly 10 is an embodiment of the present invention which can be instantly secured to a surface or substrate, such as a terminal pad 26 (FIG. 3) on automotive glass, in a manner allowing electrical connection between the electrical terminal assembly 10 and the terminal pad 26 without the use of solder or the application of heat. The electrical terminal assembly 10 includes an electrical terminal insert 12 (FIG. 4) and a retaining member or cover 14 which are assembled together.

Figure 3:
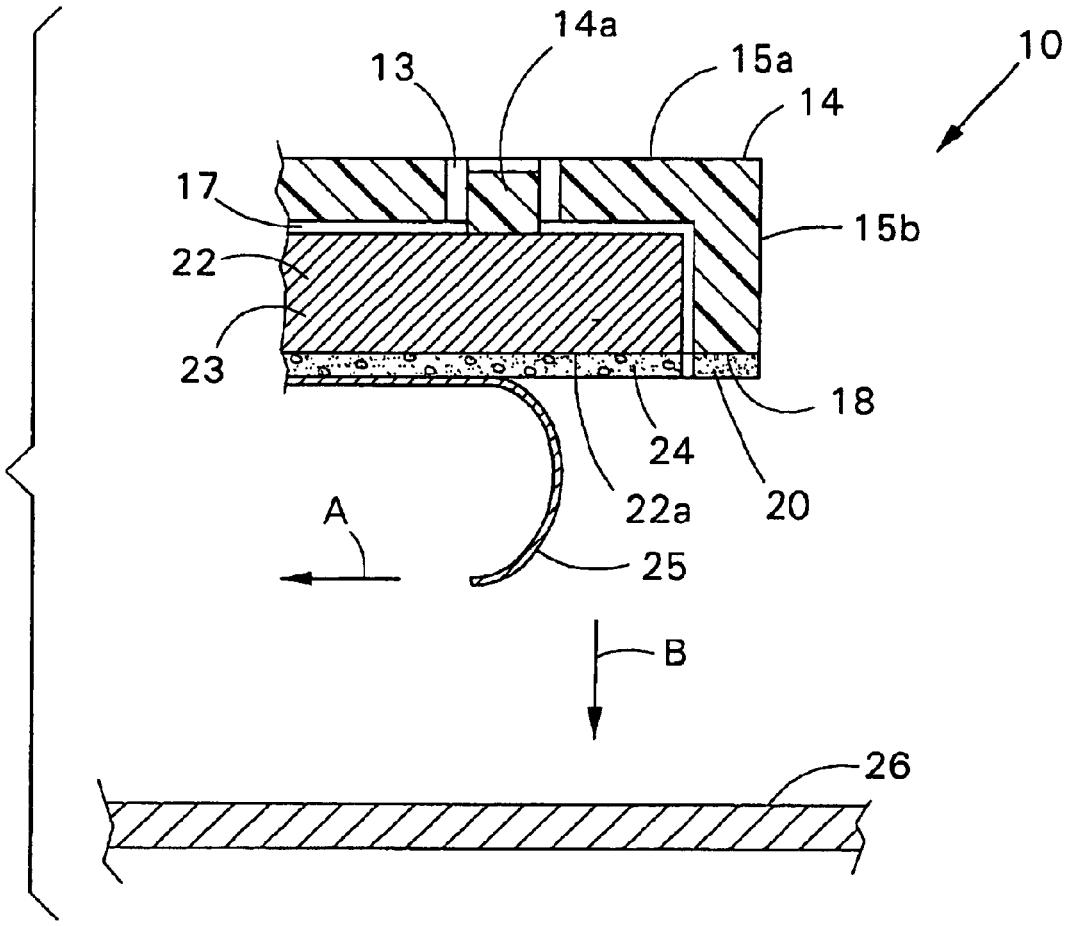
FIG. 3 is a side sectional view of a portion of the electrical terminal assembly prior to securement onto a surface or substrate.

The electrical terminal insert 12 has a base pad 22 for conductively securing to a terminal pad 26 and an electrical connector 12*a* connected to or extending from the base pad 22 for engaging a mating connector. The retaining cover 14 captures the base pad 22 of electrical terminal insert 12 within a recess 17 (FIG. 2) and includes an opening 16 in upperwall 15*a* through which the electrical connector 12*a* extends. The retaining cover 14 has a side wall 15*b* with a bottom surface 18 having a layer of instant adhesive 20 thereon. The layer of instant adhesive 20 is employed for instantly securing the retaining cover 14 to terminal pad 26 (FIG. 3). The base pad 22 has a bottom surface 22*a* having a layer of conductive adhesive 24 thereon for conductively adhering the base pad 22 to the terminal pad 26. The bottom surface 22*a* of base pad 22 forms a bottom electrical contact surface. Retaining cover 14 includes one or more resilient portions or members 14*a* for resiliently pressing base pad 22 against the terminal pad 26 to ensure electrical connection therebetween.

In use, the electrical terminal insert 12 is typically preassembled with the retaining cover 14 to form electrical terminal assembly 10, wherein the instant adhesive 20 and the conductive adhesive 24 are preapplied to bottom surfaces 18 and 22*a*, respectively. The electrical terminal assembly 10 can include a sheet of release material or paper 25 covering the instant adhesive 20 and the conductive adhesive 24 as seen in FIG. 3. The release paper 25 is pulled in the direction of the arrow A (FIG. 3) for removal. The electrical terminal assembly 10 is then pushed into contact with the terminal pad 26 in the direction of arrow B to adhere the bottom surface 18 of retaining cover 14 to terminal pad 26 with the instant adhesive 20. This securely mounts the electrical terminal insert 12 in place giving the conductive adhesive 24 the time required to cure or harden while the base pad 22 is in proper position. The resilient members 14*a* resiliently push the base pad 22 of electrical terminal insert 12 against the terminal pad 26 so that the conductive adhesive 24, when finally cured, conductively secures base pad 22 to the terminal pad 26 for electrical connection therebetween.

Some conductive adhesives 24 may provide electrical connection between the base pad 22 and the terminal pad 26 before curing. The opening 16 within the retaining cover 14 is sized with enough clearance relative to the electrical connector 12*a* to allow sufficient movement of the electrical connector 12*a* therethrough so that the base pad 22 can be resiliently pressed against terminal pad 26. The terminal pad 22 is captured within the recess 17 of retaining cover 14 which prevents lateral movement of the base pad 22 while the conductive adhesive 24 is curing or hardening once retaining cover 14 is secured into position.

Figure 4:
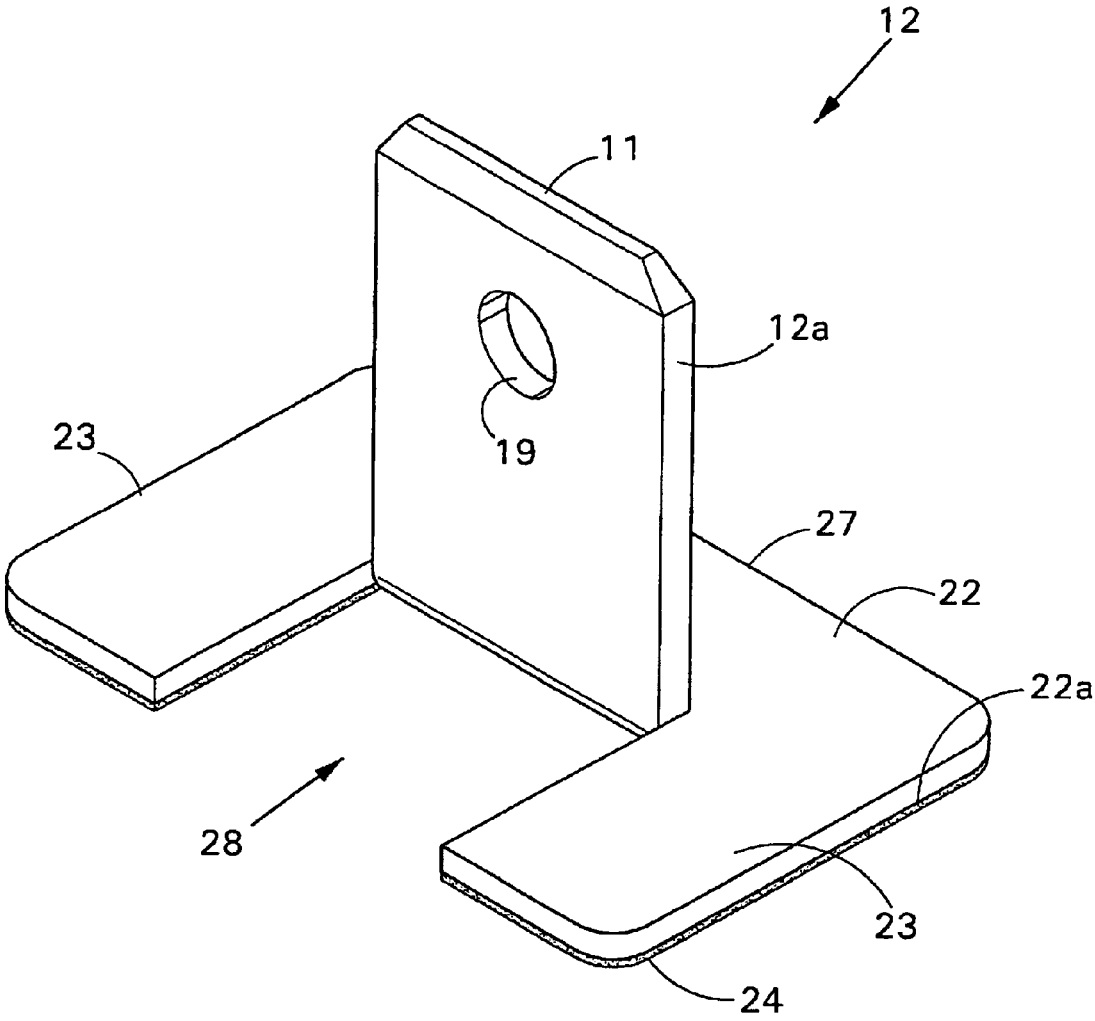
FIG. 4 is a top perspective view of the electrical terminal insert of the electrical terminal assembly of FIG. 1.

A more detailed description of the embodiment of the electrical terminal assembly 10 depicted in FIGS. 1–3 now follows. Electrical terminal insert 12 is typically formed of sheet metal such as copper, steel, aluminum, etc., in a stamping or bending process. Electrical terminal insert 12 can be plated with suitable conductive metallic materials. Referring to FIG. 4, the electrical connector 12*a* of electrical terminal insert 12 is a blade connector that is bent upwardly from the base pad 22 from a generally central region of the base pad 22. The electrical connector 12*a* has a tapered tip 11 for allowing easy engagement with a mating connector and also has a hole 19 for engaging a locking protrusion of the mating connector. Since the base pad 22 has a generally rectangular perimeter or foot print, bending the electrical connector 12*a* from the central region of base pad 22 forms two legs 23 of equal width extending from a rectangular portion 27. The two legs 23 are separated from each other by a rectangular gap 28. The outer corners of the base pad 22 are typically rounded.

With the electrical connector 12*a* extending from a generally central region of base pad 22, forces exerted on electrical connector 12*a* by a mating connector are directed to the center of the base pad 22. This allows the base pad 22 to more strongly resist such forces than if the forces were directed to an edge of the base pad 22. Edge directed forces cause a pealing action which more easily causes failure of the joint because a pealing force is resisted only by the portion of the joint along the peal line, rather than the whole joint.

The retaining cover 14 (FIGS. 1 and 2) is typically formed of a nonelectrically conductive, or insulative material such as a plastic or a polymer. Retaining cover 14 has an outer perimeter or footprint which is generally the same shape as the outer perimeter or footprint of the base pad 22 of electrical terminal 12, but is slightly larger in size. The upper wall 15*a* and side wall 15*b* surround recess 17 with the side wall 15*b* extending around the perimeter of retaining cover 14. The recess 17 is sized with sufficient clearance to accept the base pad 22 of electrical terminal insert 12 and has a depth generally approximating the thickness of base pad 22. Opening 16 extends through the upper wall 15*a* of retaining cover 14 at about the center of retaining cover 14 and is generally rectangular in shape in order to accept electrical connector 12*a* when in the form of a blade connector.

Two resilient members 14*a* are formed in the upper wall 15*a* on opposite sides of opening 16. The resilient members 14*a* are typically cantilevered beams which are formed by three sided slots 13 in the upper wall 15*a*. The resilient members 14*a* are bent slightly into recess 17 to resiliently engage base pad 22 of electrical terminal insert 12 (FIG. 3). The retaining cover 14 can increase the strength of the bond between the electrical terminal assembly 10 and the terminal pad 26 over that provided by just the conductive adhesive 24 on the terminal pad 22 of electrical terminal insert 12. Although the resilient members 14*a* are shown to extend in opposite directions parallel to each other and are rectangular in shape, alternately, resilient members 14*a* can extend in the same direction, extend at angles relative to each other, be curved, or have a complex shape. In addition, although retaining cover 14 is typically formed of plastic, alternatively, retaining cover 14 can be formed of other suitable materials such as ceramics or composites. In some applications, it may be desirable to form retaining cover 14 from conductive materials such as metals.

In other embodiments of electrical terminal assembly 10, the electrical connector 12*a* of electrical terminal insert 12 can be bent at an acute angle relative to base pad 22 rather than being perpendicular to base pad 22, or include two bends to position the tip of electrical connector 12*a* parallel to base pad 22. In addition, the electrical connector 12*a* can be other suitable male and female electrical connectors instead of a blade connector, for example, pin connectors, snap sockets, etc. The instant adhesive 20 and/or the conductive adhesive 24 in some situations can be applied at the time that the electrical terminal assembly 10 is mounted to the terminal pad 26 instead of being pre-applied. The instant adhesive 20 can in some cases, be an adhesive which may take as long as about a minute to cure and bond the retaining cover 14 to the terminal pad 26. The conductive adhesive 24 can be replaced with a nonadhesive conductive substance such as a conductive gel, thereby relying entirely on the holding force of the instant adhesive 20. Alternatively, conductive substances between the base pad 22 and the terminal pad 26 can be omitted altogether, so that the base pad 22 relies solely on pressure against the terminal pad 26 for electrical connection therebetween. In such a case, the bottom surface 22*a* of base pad 22 can be provided with a series of pointed protrusions to engage the terminal pad 26. In some cases, the retaining cover 14 can be secured to a nonconductive substrate or surface with the base pad 22 of the electrical terminal insert 12 contacting a conductive surface that is smaller than the footprint of the retaining cover 14.

Figure 5:
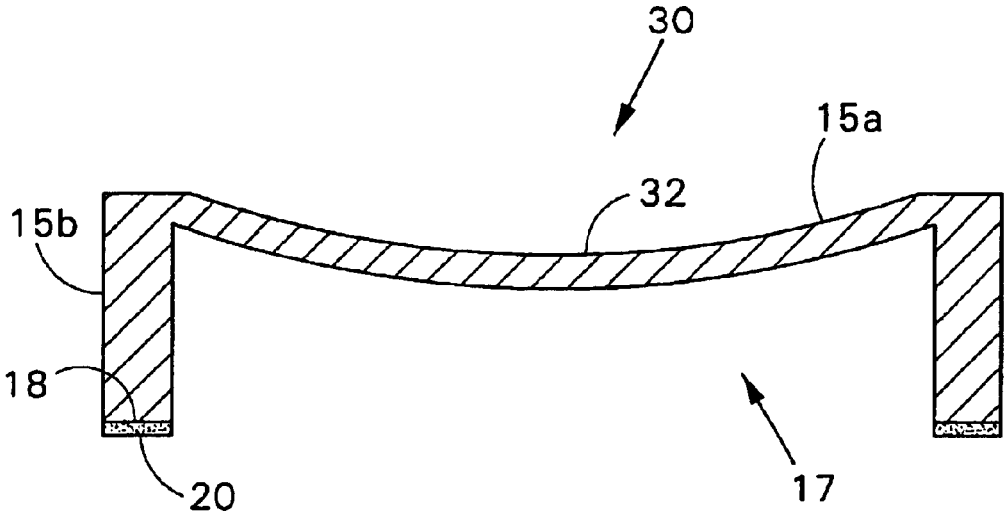
FIG. 5 is a sectional view of another embodiment of a retaining cover.

Referring to FIG. 5, retaining member or cover 30 is another embodiment of a retaining cover in the present invention which differs from retaining cover 14 in that retaining cover 30 includes an upper wall 15*a* with one or more downwardly bowed resilient wall portions 32, which when engage the base pad 22 of electrical terminal insert 12, deflect upwardly. This provides a resilient force against the base pad 22 to press the base pad 22 against the terminal pad 26. Typically, the side wall 15*b* encircles the perimeter of base pad 22 of electrical terminal insert 12. Alternatively, side wall 15*b* can have an opening on one side. In such a case, the retaining cover 30 can be premounted to terminal pad 26 and then the base pad 22 of the electrical terminal 12 can later be slid into the recess 17 of retaining cover 14 through the opening. Conductive adhesive 24 can be applied to the base pad 22 or on the terminal pad 26 within the recess 17.

Figure 6:
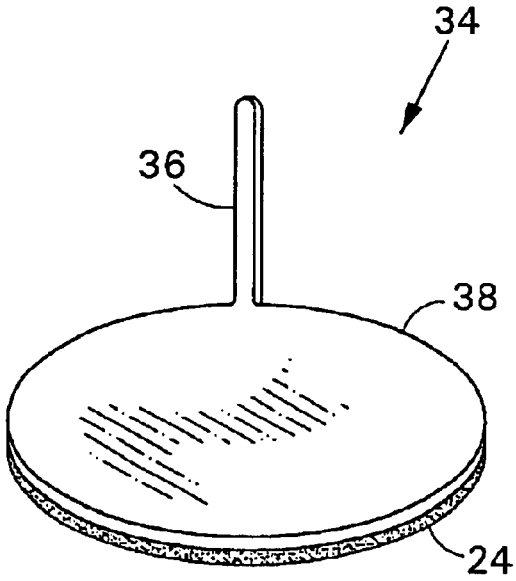
FIG. 6 is a perspective view of another embodiment of an electrical terminal insert.

Referring to FIG. 6, electrical terminal insert 34 is another embodiment of an electrical terminal insert in the present invention which differs from electrical terminal insert 12 in that the base pad 38 is circular in shape and that the electrical connector 36 is a pin connector which extends from the edge of the base pad 38. It is understood that the retaining cover employed with electrical terminal insert 34 (14 or 30), would be formed to accommodate such a configuration. For example, the recess 17 would be circular in shape to accept base pad 38, and the opening 16 in the upper wall 15*a* would be positioned near the side with the appropriate shape to accept electrical connector 36. In other embodiments, electrical connector 36 can be other suitable male or female connectors such as a blade connector, a female socket, etc. Furthermore, electrical connector 36 can be configured for soldering or crimping to a conductor. It is understood that base pad 38 can have other suitable shapes such as generally rectangular, oval etc.

Figure 7:
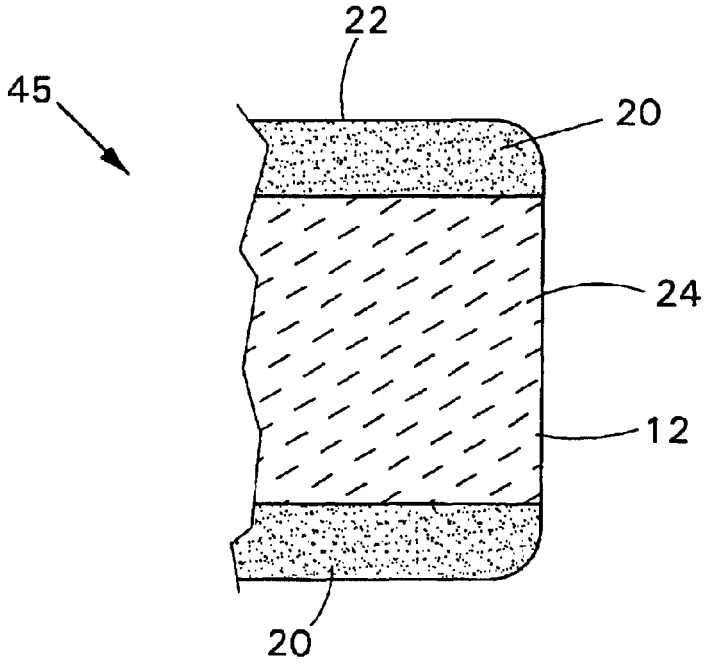
FIG. 7 is a bottom view of a portion of another embodiment of the present invention electrical terminal assembly.

Referring to FIG. 7, in another embodiment of an electrical terminal assembly 45, the bottom surface 22*a* of the base pad 22 of an electrical terminal insert 12 can include both regions of instant adhesive 20 for instantly securing base pad 22 to terminal pad 26, as well as regions of conductive adhesive 24 for conductively adhering the base pad 22 to terminal pad 26. The region of the base pad 22 covered by the conductive adhesive 24 forms the bottom electrical contact surface of the base pad 22. As a result, the retaining cover 14 can be omitted since the instant adhesive 20 is on the base pad 22.

The instant adhesive 20 and conductive adhesive 24 can be applied to the base pad 22 by applying the adhesives 20/24 to a release material or paper and then combining the adhesive covered release paper with the bottom surface of the base pad 22. Alternatively, the base pad 22 can include regions of instant adhesive 20 with the conductive adhesive 24 being applied at the time of mounting, either to the base pad 22, or to the terminal pad 26. It is understood that the use of both instant 20 and conductive adhesives 24 on a base pad can be employed on base pads of any shape. In addition, the conductive adhesive 24 can be replaced with a nonadhesive conductive substance such as a conductive gel or omitted altogether.

Figure 8:
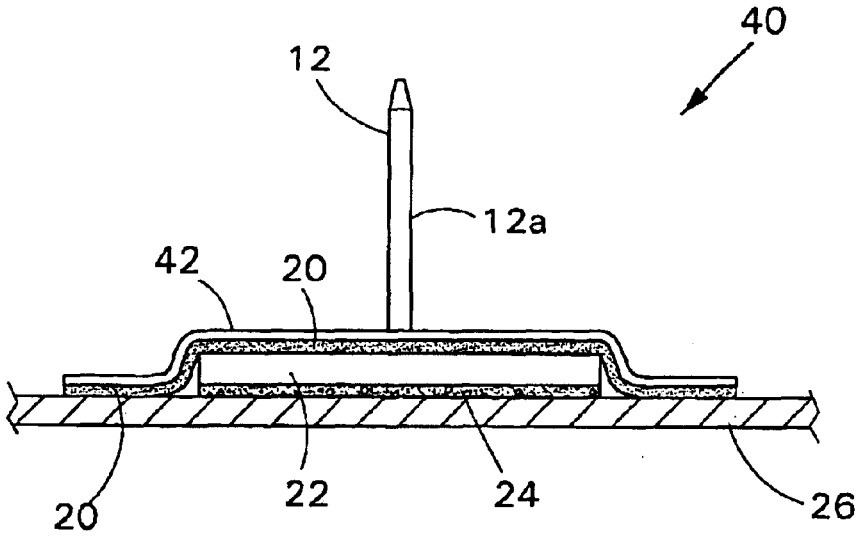
FIG. 8 is a side view of yet another embodiment of the present invention electrical terminal assembly.

In another embodiment, the base pad 22 of electrical terminal insert 12 can be instantly secured to terminal pad 26 by a flexible tape 42 having instant adhesive 20 thereon, thereby forming an electrical terminal assembly 40 as seen in FIG. 8. The flexible tape 42 need only to secure the base pad 22 in position until the conductive adhesive 24 on the base pad 22 cures or hardens to permanently secure the electrical terminal insert 12 in place.

While this invention has been particularly shown and described with references to preferred embodiments thereof, it will be understood by those skilled in the art that various changes in form and details may be made therein without departing from the scope of the invention encompassed by the appended claims.

For example, although terms have been used such as upper, side, bottom, downwardly, etc. to describe the present invention, such language is not meant to limit the orientation of the electrical terminal assembly and components therein but merely are used to describe the relative position of various features. In addition, various features of the embodiments described above and depicted in the drawings can be combined together or omitted. Furthermore, although the present invention electrical terminal assembly has been primarily described for securement to terminal pads on automotive glass it is understood that the electrical terminal assembly can be secured to any suitable surface.

What is claimed is:

1. An electrical terminal assembly comprising:

an electrical terminal comprising an electrical connector for engaging a mating connector, and a base pad extending from the electrical connector having a bottom electrical contact surface; and a securement arrangement comprising a retaining cover for pressing the base pad against a substrate, the retaining cover having an instant adhesive surface on a bottom surface that is adjacent to the bottom electrical contact surface of the base pad for instantly securing to a surface on the substrate, the retaining cover including at least one resilient member for resiliently pressing against the base pad for pressing the bottom electrical contact surface against the surface on the substrate, the at least one resilient member being a cantilevered beam formed within the retaining cover.

2. The terminal assembly of claim 1 in which the electrical connector is a blade connector.

3. The terminal assembly of claim 1 further comprising a layer of conductive adhesive on the bottom electrical contact surface of the base pad.

4. The terminal assembly of claim 3 in which the retaining cover includes an upper wall extending over the base pad of the electrical terminal and a side wall extending around the base pad for capturing the electrical terminal.

5. The terminal assembly of claim 4 in which the upper wall of the retaining cover includes an opening through which the electrical connector of the electrical terminal is extended.

6. An electrical terminal assembly comprising:

an electrical terminal comprising an electrical connector for engaging a mating connector, and a base pad extending from the electrical connector having a bottom electrical contact surface with a layer of conductive adhesive thereon; and a securement arrangement comprising a retaining cover for pressing the base pad against a substrate, the retaining cover having an instant adhesive surface on a bottom surface that is adjacent to the bottom electrical contact surface of the base pad for instantly securing to said substrate, the retaining cover including at least one resilient member for resiliently pressing against the base pad for pressing the bottom electrical contact surface against the surface on the substrate, the at least one resilient member being a cantilevered beam formed within the retaining cover.

7. The terminal assembly of claim 6 in which the electrical connector is a blade connector.

8. The terminal assembly of claim 6 in which the retaining cover includes an upper wall extending over the base pad of the electrical terminal and a side wall extending around the base pad.

9. The terminal assembly of claim 8 in which the upper wall of the retaining cover includes an opening through which the electrical connector of the electrical terminal is extended.

10. A method of forming an electrical terminal assembly comprising:

providing an electrical terminal comprising an electrical connector for engaging a mating connector, and a base pad extending from the electrical connector having a bottom electrical contact surface; and positioning an instant adhesive surface of a securement arrangement adjacent to the bottom electrical contact surface of the base pad for instantly securing to a surface on a substrate, the securement arrangement comprising a retaining cover for pressing the base pad against said substrate and having the instant adhesive surface on a bottom surface of the retaining cover for securing the retaining cover to said substrate, the retaining cover included at least one resilient member for resiliently pressing against the base pad for pressing the bottom electrical contact surface against the surface on the substrate, the at least one resilient member being a cantilevered beam formed within the retaining cover.

11. The method of claim 10 further comprising forming a layer of conductive adhesive on the bottom electrical contact surface of the base pad.

12. The method of claim 11 further comprising forming the retaining cover with an upper wall extending over the base pad of the electrical terminal and a side wall extending around the base pad for capturing the electrical terminal.

13. The method of claim 12 further comprising forming an opening through the upper wall of the retaining cover for extending the electrical connector of the electrical terminal there through.

14. A method of securing an electrical terminal to a surface on a substrate, the electrical terminal comprising an electrical connector for engaging a mating connector, and a base pad extending from the electrical connector having a bottom electrical contact surface, the method comprising instantly securing an instant adhesive surface of a securement arrangement laterally adjacent to the bottom electrical contact surface of the base pad to the surface on the substrate, the securement arrangement including at least one resilient member integrally formed therein for resiliently pressing against the base pad for pressing the bottom electrical contact surface against the surface on the substrate.

15. The method of claim 14 further comprising further securing the base pad to said substrate with a layer of conductive adhesive on the bottom electrical contact surface.

16. The method of claim 15 in which the securement arrangement further comprises a retaining cover, the method further comprising pressing the base pad against said substrate with the retaining cover, the instant adhesive surface being on a bottom surface of the retaining cover for securing the retaining cover to said substrate.

17. The method of claim 16 further comprising pressing the base pad against said substrate with at least one resilient member formed within the retaining cover.

18. An electrical terminal assembly comprising:

an electrical terminal comprising an electrical connector for engaging a mating connector, and a base pad extending from the electrical connector having a bottom electrical contact surface; and a securement arrangement having an instant adhesive surface laterally adjacent to the bottom electrical contact surface of the base pad for instantly securing the securement arrangement to a surface on a substrate, the securement arrangement including at least one resilient member integrally formed therein for resiliently pressing against the base pad for pressing the bottom electrical contact surface against the surface on the substrate.

* * * * *